US008158899B2

(12) United States Patent
Bloch

(10) Patent No.: US 8,158,899 B2
(45) Date of Patent: Apr. 17, 2012

(54) WATERPROOF OPERATING DEVICE

(75) Inventor: Nathan D. Bloch, Cherry Hill, NJ (US)

(73) Assignee: Pioneer & Co., Inc., Moorestown, NJ (US)

( * ) Notice: Subject to any disclaimer, the term of this patent is extended or adjusted under 35 U.S.C. 154(b) by 223 days.

(21) Appl. No.: 12/717,451

(22) Filed: Mar. 4, 2010

(65) Prior Publication Data

US 2011/0214976 A1 Sep. 8, 2011

(51) Int. Cl.
*H01H 13/06* (2006.01)

(52) U.S. Cl. ..... 200/302.2

(58) Field of Classification Search ..... 200/341, 200/302.1–302.3, 5 R, 304
See application file for complete search history.

(56) References Cited

U.S. PATENT DOCUMENTS

| | | | | |
|---|---|---|---|---|
| 2,981,816 | A | 4/1961 | Cozart | |
| 3,890,480 | A | 6/1975 | Berling et al. | |
| 4,170,104 | A * | 10/1979 | Yamagata | 368/289 |
| 5,172,805 | A | 12/1992 | Gumb | |
| 5,258,592 | A | 11/1993 | Nishikawa et al. | |
| 5,367,133 | A | 11/1994 | Schmidt et al. | |
| 5,933,133 | A | 8/1999 | Lohr | |
| 5,952,634 | A | 9/1999 | Yoshida | |
| 6,054,939 | A | 4/2000 | Wei et al. | |
| 6,354,210 | B1 | 3/2002 | Chao | |
| 6,467,683 | B2 | 10/2002 | Jun | |
| 6,963,039 | B1 | 11/2005 | Weng et al. | |
| 7,038,598 | B2 | 5/2006 | Uke | |
| 7,230,195 | B2 * | 6/2007 | Ohnishi | 200/302.1 |
| 7,355,137 | B2 | 4/2008 | Kawasaki et al. | |
| 7,525,792 | B2 * | 4/2009 | Yokote | 361/679.02 |
| 2009/0020402 | A1 | 1/2009 | Ichikawa et al. | |

FOREIGN PATENT DOCUMENTS

| | | | |
|---|---|---|---|
| CH | 613592 | A | 10/1979 |
| JP | 53020957 | A | 2/1978 |

* cited by examiner

*Primary Examiner* — Edwin A. Leon
(74) *Attorney, Agent, or Firm* — Panitch Schwarze Belisario & Nadel LLP

(57) ABSTRACT

A waterproof operating device has a pressure resistant housing including a support surface with one or more openings therethrough; a cover plate having corresponding openings therethrough; an elastic member having opposing major surfaces facing the support and cover plates with a protrusion extending from one major surface through an opening in the support surface. A button shaft extends through each pair of aligned openings into the protrusion. Each opposing major surface of the elastic member is maintained in direct continuous contact with the cover and support plates from the openings in the support and cover plates outward to beyond an area covered by the head portion of the button. The protrusion is dimensional for the selected elastic material and button dimensions to resist elongation from water pressure at greater than sixty meter depths, sufficient to actuate a switch element proximal to the distal end of the protrusion.

24 Claims, 3 Drawing Sheets

WATERPROOF OPERATING DEVICE

BACKGROUND OF THE INVENTION

The present invention is directed to a waterproof operating device having superior resistance to water pressure. More particularly, the present invention is directed to a waterproof operating device for use in underwater electronic devices.

Electronic devices designed for underwater use are generally known. Examples of such devices include cameras, watches, computers, hand lights, etc. Often, underwater electronic devices are equipped with one or more buttons for actuation of one or more corresponding switch elements in order to initiate the desired operations. To protect the switch elements from water damage, underwater electronic devices must be equipped with a waterproof seal. Such a waterproof seal is typically achieved by surrounding a portion of the shaft of each button by an O-ring. However, the necessary installation of an O-ring for each button results increased manufacture costs and delay. Also, O-rings are susceptible to failure due to contamination that may be caused, for example, by suspended particulates in the water and by the build-up of salt in the O-rings.

Underwater electronic devices must also be equipped with a means to prevent unintentional depression of the buttons and unintentional actuation of the corresponding switch elements. Specifically, each button must generate sufficient spring force to resist water pressure from unintentionally depressing the buttons. The requisite spring force for each button is typically achieved in one of two ways: the electronic device may be filled with a viscous fluid, such as silicone oil, or, alternatively, each button maybe equipped with a compression spring. However, the conventional configuration of underwater electronic devices cannot resist water pressure up to great depths in water without actuation of the switch elements.

Therefore, it would be desirable to provide a waterproof operating device that can withstand water pressure exerted upon buttons up to much greater depths without actuation of the switch elements. It would also be desirable to provide a simpler and more efficient mechanism for attaining a waterproof seal for such operating devices to be utilized in electronic devices designed for underwater use. It is further desirable to provide a simpler waterproof operating device that is not adversely affected by contamination present in an underwater environment.

BRIEF SUMMARY OF THE INVENTION

Briefly stated, the present invention is directed to a waterproof operating device including a pressure resistant housing, a cover plate, an elastic member, at least one button, and at least one switch element located within the housing. The pressure resistant housing includes a support surface with at least one opening formed therethrough. The cover plate is positioned over the support surface and has at least one opening formed therethrough located over the at least one opening formed through the support surface. The elastic member is located between the support surface and the cover plate and has a first major surface in direct contact with the cover plate, a second major surface opposite the first major surface in direct contact with the support surface, and at least one protrusion extending from the second major surface and through the at least one opening through the support surface. The protrusion includes an open end at the first major surface aligned with the at least one opening through the cover plate, an opposing closed end and a tubular wall. The tubular wall extends between the second major surface and the opposing closed end and passes through the at least one opening in the support surface. The elastic member has a thickness from the protrusion radially outward all around the protrusion, such that the first major surface is maintained in continuous direct contact with the cover plate and the second major surface is maintained in continuous direct contact with the support surface from the at least one opening through the support surface receiving the protrusion and the button and the at least one opening through the cover plate outward at least beyond an area covered by the head portion of the button. The at least one button has a head portion and a shaft portion. A majority of an entire length of the shaft portion is received within the protrusion of the elastic member by a close-fitting relationship. A distal tip of the shaft portion engages the closed end of the protrusion, wherein the protrusion of the elastic member is stretched in a direction parallel to a tubular length of the protrusion with the button being depressed. The at least one switch element is actuated by the closed end of the protrusion of the elastic member with the button sufficiently depressed.

BRIEF DESCRIPTION OF THE SEVERAL VIEWS OF THE DRAWINGS

The following detailed description of the preferred embodiment of the invention will be better understood when read in conjunction with the appended drawings. For the purpose of illustrating the invention, there is shown in the drawings an embodiment which is presently preferred. It should be understood, however, that the invention is not limited to the precise arrangements and instrumentalities shown.

In the drawings.

DETAILED DESCRIPTION OF THE INVENTION

Figure 1:
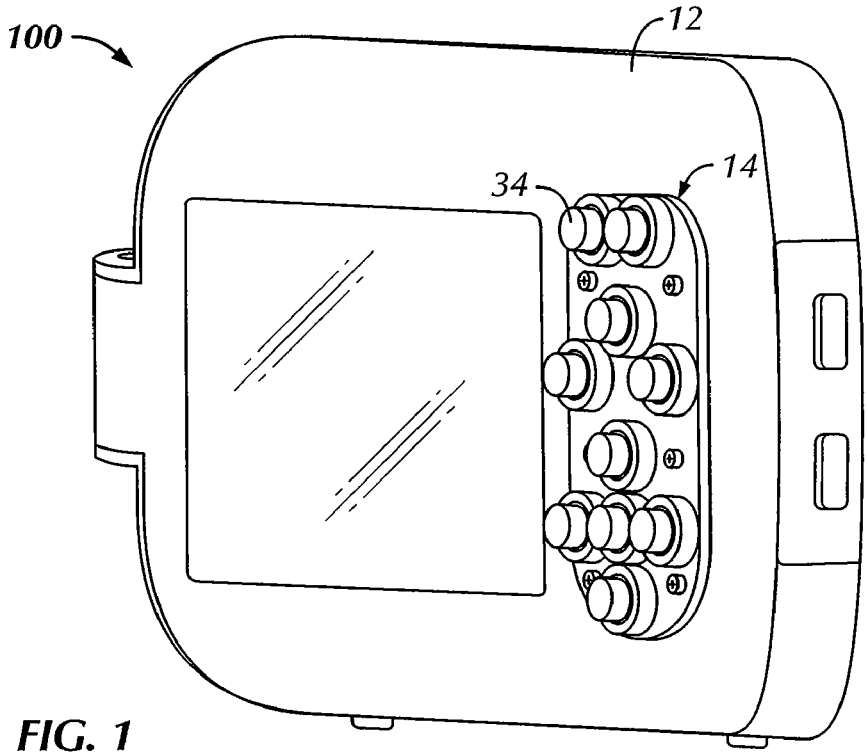
FIGS. 1 is a perspective view of the waterproof keypad in accordance with a preferred embodiment of the present invention in an assembled configuration.

Certain terminology is used in the following description for convenience only, and is not limiting. The words "right," "left," "upper," and "lower" designate directions in the drawings to which reference is made. The words "inwardly" and "outwardly" refer to directions toward and away from, respectively, the geometric center of the waterproof operating device and designated parts thereof. Additionally, the word "a" as used in the specification means "at least one." The terminology includes the words specifically mentioned, derivatives thereof and words of similar import.

Figure 2:
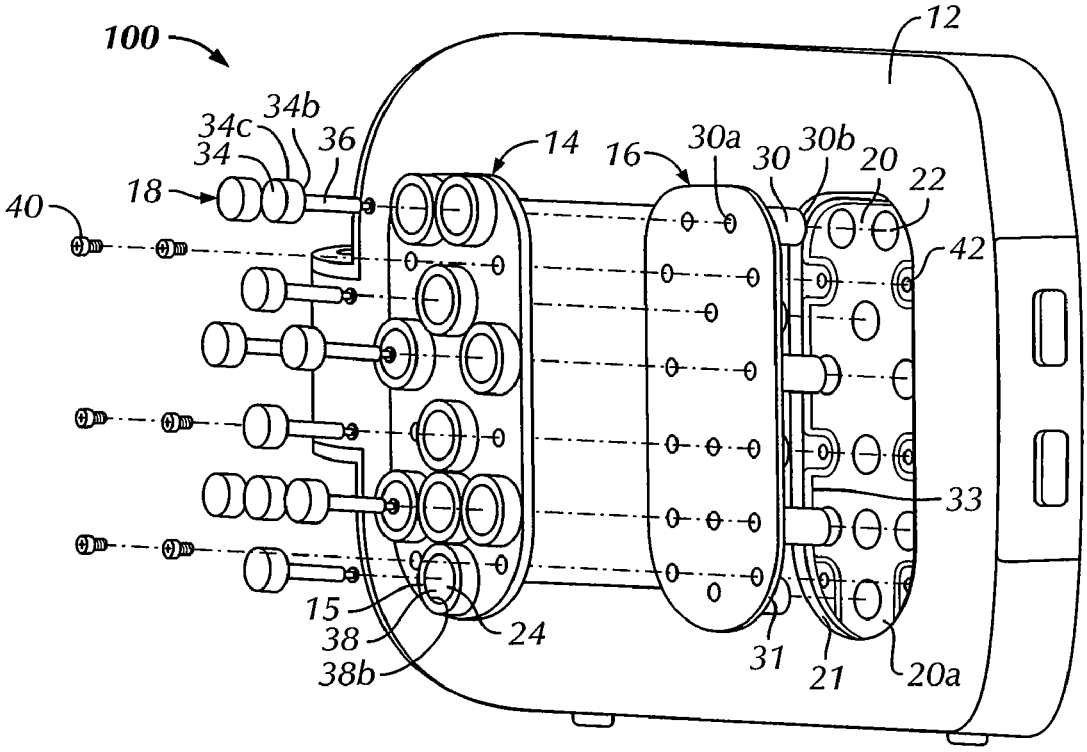
FIG. 2 is a perspective exploded view of the waterproof keypad shown in FIG. 1.

Referring to FIGS. 1-2, a waterproof operating device 10 includes a housing 12, a cover plate 14 and an elastic member 16. In the attached figures, the waterproof operating device 10 is shown as being utilized in an underwater camera. However, the waterproof operating device 10 may be utilized in any type of electronic device designed for underwater use.

The housing 12 includes a support surface 20, which is inelastic and, more preferably, rigid. The housing 12 is a pressure resistant housing and is preferably may be made of, for example, a polycarbonate. However, it will be understood by those of ordinary skill in the art that the housing 12 may be made of any appropriate material for underwater use, such as stainless steel. An elastomeric coating may optionally be applied to the housing 12 for both abrasion and impact resistance purposes and to increase the aesthetic appeal of the housing 12. The support surface 20 has at least one opening 22 formed therethrough and, more preferably, has a plurality of openings 22 formed therethrough. The opening 22 extends through the entire thickness of the support surface 20 and, preferably, is generally cylindrical in shape. However, the opening 22 may be of any appropriate shape, such as ovular or elliptical.

The cover plate 14 is inelastic and more preferably rigid, and may be made of, for example, aluminum, stainless steel or a polymeric material. Preferably, the cover plate 14 is made of a polycarbonate material. The cover plate 14 preferably includes at least one raised cylindrical section 15 which includes a depression or well 38 formed therein. Preferably, the well has a height of at least 0.080 inches. More preferably, the cover plate 14 includes a plurality of cylindrical sections 15 and corresponding wells 38 formed therein.

Figure 3:
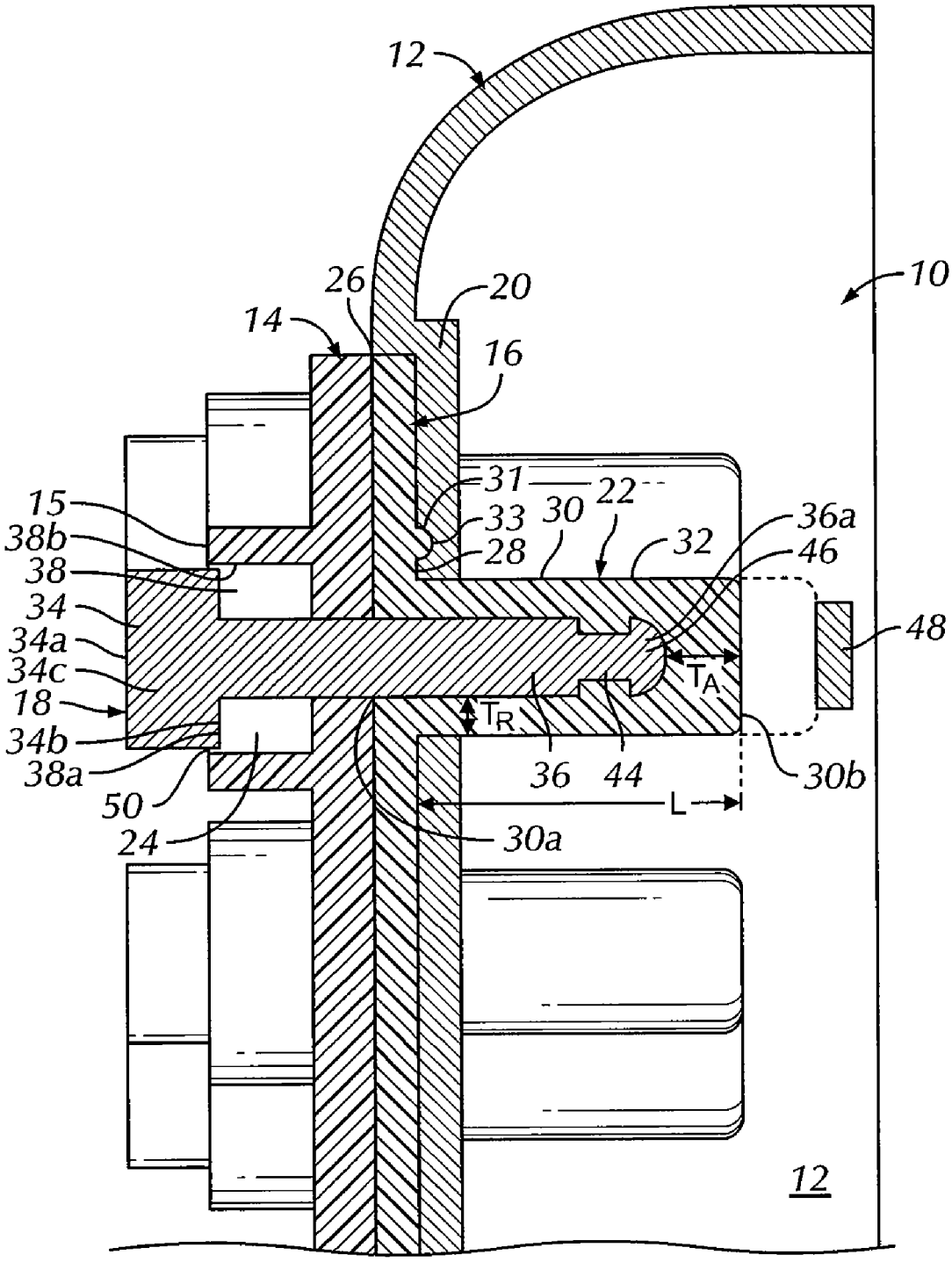
FIG. 3 is a cross-sectional view of a waterproof operating device in accordance with a preferred embodiment of the present invention.

Referring to FIGS. 1-3, in the assembled configuration, the cover plate 14 is positioned over the support surface 20 and includes at least one opening 24 formed therethrough and, more preferably, includes a plurality of openings 24 formed therethrough. Specifically, the opening 24 is formed in and extends through the well 38 formed in the cover plate 14. Similar to the design of the opening 22, the opening 24 extends through a thickness of the cover plate 14 and, preferably, is generally cylindrical in shape. In the assembled configuration, the opening 24 formed through the cover plate 14 is located over the opening 22 formed through the support surface 20. The openings 24 and 22 of the pluralities are at least generally coaxially aligned with each other.

Referring to FIGS. 1 and 3, in the assembled configuration, the elastic member 16 is located between the support surface 20 and the cover plate 14. The elastic member 16 has a first major surface 26, a second major surface 28 opposite the first major surface 26, and at least one protrusion 30 extending from the second major surface 28. The first major surface 26 is in direct contact with the cover plate 14 and the second major surface 28 is in direct contact with the support surface 20. Further, the protrusion 30 extends through the at least one opening 22 formed through the support surface 20. Preferably, if the support surface 20 includes a plurality of through openings 22 and the cover plate 14 includes a plurality of through openings 24, the elastic member 16 contains a plurality of protrusions 30 as shown in FIG. 2, one for each axially aligned pair of openings 22, 24. The elastic member 16 is a stretchable one-piece elastomeric membrane that may be made of, for example, silicone, urethane, or EPDM rubber. Preferably, the elastic member 16 is made of silicone.

Each protrusion 30 includes an open end **30*a* at the first major surface 26 and an opposing closed end 30*b*. More particularly, the open end 30*a* of each protrusion extends through the thickness of the elastic member and is generally aligned with the at least one opening 24 formed through the cover plate 14. A tubular wall 32 of the protrusion 30 extends between the second major surface 28 of the elastic member 16 and the closed end 30*b* of the protrusion 30. Accordingly, the protrusion 30 has a generally cylindrical shape and a recess formed by the tubular wall 32 between the open end 30*a* and the distal and opposing closed end 30*b*** is configured to receive an object.

The diameter of the opening 22 in the support surface 20 is preferably just slightly larger than that of the tubular wall 32 of the protrusion 30 for ease of assembly, but may, in fact, be equal to or even slightly smaller that that of the tubular wall 32, for better sealing. As such, in the assembled configuration with the elastic member 16 positioned between the cover plate 14 and the support surface 20, the tubular wall 32 is of a sufficient size to pass through the opening 22 in the support surface 20 (see FIGS. 2-3). Preferably, the difference in the diameters of the tubular wall 32 and the opening 22 is approximately 0.005 inches. Where the elastic member 16 includes a plurality of protrusions 30, each protrusion 30 underlies one of the plurality of openings 24 in the cover plate 14 and the tubular wall 32 of each protrusion 30 extends through a separate, corresponding opening 22 of the plurality of openings 22 in the support surface 20.

The elastic member 16 has a thickness from the open end **30*a* of each protrusion 30 radially outward all around the protrusion 30 such that the first major surface 26 is maintained in continuous direct contact with the cover plate 14 and the second major surface 28 is maintained in continuous direct contact with the support surface 20. Accordingly, the elastic member 16 is maintained between and in continuous direct contact with the cover plate 14 and the support surface 20 from the protrusion 30 outward by a close-fitting relationship. Essentially, the elastic member 16 is sandwiched between the cover plate 14 and support surface 20**, such that direct contact is maintained over the entire overlapping areas of the three components.

Where the elastic member 16 includes a plurality of protrusions 30, the thickness of the elastic member 16 between the first and second major surfaces 26 and 28, respectively, preferably is uniform (i.e. at least essentially constant) between at least one adjoining pair of the plurality of the protrusions and, more preferably, between each adjoining pair of the plurality of protrusions 30. Accordingly, in the assembled configuration, the first major surface 26 of the elastic member 16 (where the elastic member 16 is present) is in continuous direct contact with the cover plate 14 between adjoining pairs of openings 24 and more preferably, everywhere the elastic member 16 is overlapped by the cover plate 14. Similarly, the second major surface 28 of the elastic member 16 (where the elastic member 16 is present) is in continuous direct contact with the support surface 20 between adjoining pairs of openings 22 and more preferably, everywhere the elastic member 16 overlaps the support surface 20. Because the elastic member 16 is compressed and retained tightly between the cover plate 14 and the support surface 20, the elastic member 16 is not further stretchable between the first and second major surfaces 26 and 28, respectively. Thus, a waterproof seal is achieved around the openings 22, 24 and the protrusion 30.

Referring to FIG. 2, elastic member 16 further preferably includes a ridge 31 which extends or protrudes out from the second major surface 28 of the elastic member 16. The ridge 31 extends around an outer perimeter of the elastic member 16. Preferably, the ridge 31 completely and unbrokenly (i.e., continuously) surrounds the protrusion 30. Where the elastic member 16 includes a plurality of protrusions 30, as shown in FIG. 2, the ridge 31 completely and unbrokenly (i.e., continuously) surrounds the plurality of protrusions 30. In addition, the support surface 20 further includes a recessed area 33 of a similar size and shape as the ridge 31, such that the recessed area 33 is configured to receive the ridge 31. The configuration of the ridge 31 and the recessed area 33 acts as a gasket structure for an increased sealing effect. Specifically, because the ridge 31 mates with the recessed area 33 in the support surface 20, the sealing surface area of the elastic member 16 is increased for better waterproof protection. Further, the ridge 31 and recessed area 33 prevent the elastic member 16 from being drawn into any of the plurality of openings 22 formed through the support surface 20. Instead, because the ridge 31 is received within the recessed area 33, an additional spring force is generated primarily around the perimeter of the elastic member 16 to resist the elastic member 16 being pulled or drawn into the through openings 22.

Figure 4:
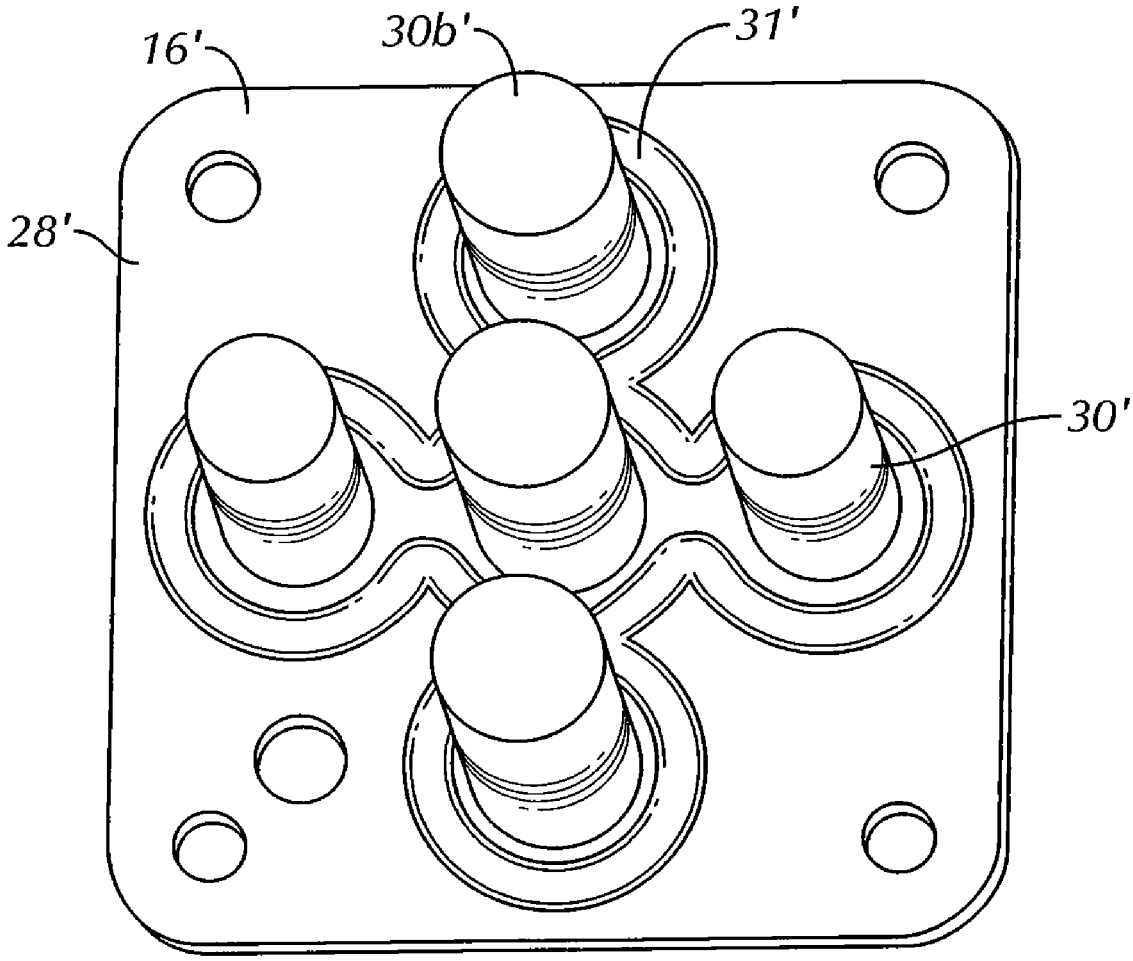
FIG. 4 is a bottom plan view of a portion of an elastic member in accordance with another preferred embodiment of the present invention.

In an alternative embodiment, shown in FIG. 4, an elastic member 16' preferably includes a ridge 31' which extends or protrudes out from a second major surface 28' of the elastic member 16' so as to extend around at least a portion of a circumference of each protrusion 30' and, more particularly, around a circumference of a tubular wall 32' of each protrusion 30', closer to the protrusion 30' than the ridge 31 of the elastic member 16 of the first embodiment. Preferably, the ridge 31' completely and unbrokenly (i.e., continuously) surrounds the circumference of the protrusion 30'. Where the elastic member 16' includes a plurality of protrusions 30', as shown in FIG. 4, the ridge 31' completely and unbrokenly (i.e., continuously) surrounds the plurality of protrusions 30', but is still beyond an area that would be covered by the head portion of any buttons received in the protrusions 30'. The ridge 31' is received within a recessed area (not shown) of a similar size and shape as the ridge 31'. Because the ridge 31' is received within the recessed area, an interference engagement is provided between the elastic member 31' and support surface 20 to resist the elastic member 16' around the tubular wall 32' of each protrusion 30' being pulled or drawn into the through openings 22.

Referring to FIGS. 1-3, in the assembled configuration, the support surface 20, the cover plate 14 and the elastic member 16 are removably and tightly secured to each other by a plurality of retaining members 40. The retaining members 40 pass entirely through openings 17 and 19 in the cover plate 14 and the elastic member 16, respectively, and into the closed-end of recesses 42 formed in the support surface 20. Preferably, the recesses 42 are threaded and the retaining members 40 are threaded fasteners, such as screws or bolts, with matching or corresponding threads. However, the retaining members 40 may be in the form of any appropriate securing or attaching means, such as nuts, bayonet fasteners or even dowels or tight-fitted pins, etc., as external water pressure will keep the cover plate 14 firmly pressed against the elastic member 16 and the support surface 20.

The waterproof operating device 10 further includes at least one button 18 and, more typically, a plurality of buttons 18. Each button 18 includes a head portion 34 and a shaft portion 36. In the assembled configuration, the head portion 34 of the button 18 is received within the corresponding well 38 of the cover plate 14 with a radial clearance 50 being provided between a radial periphery 34*c* of the head portion 34 and an inner wall 38*b* of the corresponding well 38. The clearance 50 allows water to penetrate under the head portion 34 of the button 18, thereby reducing the amount of water pressure that would typically be exerted on the head portion 34, and allowing water pressure to be directly exerted on the shaft portion 36 the button 18 instead. The well 38 provides support for the button 18, such that the button 18 does not move from side to side or lean on one side while the button 18 is being depressed, which could cause binding or pinching of the elastic member 16.

A first major surface 34*a* of the head portion 34 is provided for contact by a user. The first major surface 34*a* faces away from the well 38. A second major surface 34*b* is also provided opposite the first major surface 34*a* and facing the cover plate 14. The user depresses the button 18 by contacting the first major surface 34*a* and applying force to the head portion 34 to move the button 18 and to initiate a desired operation. However, movement of the button 18 may be limited by a bottom or closed end 38*a* of the well 38. More specifically, when the button 18 is depressed, the head portion 34 may be permitted to contact and be stopped by a closed end of the well 38 in the cover plate 14. Accordingly, the button 18 can only move the limited distance of approximately 0.080 inches. Thus, there is essentially a gap of a depth of 0.080 inches between the second major surface 34*b* of the head portion 34 and the closed end of the well 38. The well 38 serves as a protective ring that covers the gap, so that a user will not be able to pry the button 18 out of the cover plate 14.

The shaft portion 36 of the button 18 extends through the opening 24 in the cover plate 14, and at least a portion of the length of the shaft portion 36 is received within the protrusion 30 of the elastic member 16 by a close-fitting relationship, such that a distal tip 36*a* of the shaft portion 36 engages the closed end 30*b* of the protrusion 30. Preferably, a majority of the entire length of the shaft portion 36 is received within the protrusion 30. The close-fitting relationship is achieved because the elasticity of the protrusion 30 enables the recess formed between the open end 30*a* and the closed end 30*b* to conform to the size, and more particularly the diameter, of the shaft portion 36 received therein. The diameter of the shaft portion 36 is generally substantially smaller than a diameter of the head portion 34.

The distal tip 36*a* of the shaft portion 36 comprises an elongated body 44 and a flange 46 (see FIG. 1). The elongated body 44 is of a cross-sectional size smaller than the cross-sectional size of the remainder of shaft portion 36. More particularly, the elongated body 44 is of a diameter less than a diameter of a remainder of the shaft portion 36, such that the button 18 is secured within the protrusion 30 of the elastic member 16 by the flange 46, which preferably is of a maximum diameter of at least equal to that of the remainder of the shaft portion 36. Such a configuration of the distal tip 36 ensures that the button 18 remains secured within the protrusion 30, so that the button 18 will be mechanically retained within the protrusion 30 and not easily be removed therefrom, such as by the spring action of the elastic member 16, external vibrations or by the user. Other forms of mechanical and even adhesive engagement can be used.

Movement of the button 18 will result in stretching of the protrusion 30. Specifically, when the button 18 is depressed, the protrusion 30 of the elastic member 16 is stretched in a direction parallel to a tubular length L of the protrusion 30, such that the distal closed end 30*b* of the protrusion 30 moves in the direction parallel to the tubular length L. The elastic member 16 is maintained in continuous and direct contact with the cover plate 14 and the support surface 20 from the at least one opening 22 formed through the support surface 20, which receives the protrusion 30, and the at least one opening 24 formed through the cover plate 14 outward at least beyond an area covered by the head portion 34 of each button 18

Where the device 10 includes a plurality of buttons 18, the head portion 34 of each button 18 is received within a corresponding well 38, spaced apart from the inner wall 38*b* of the well 38, and a majority of the entire length of the shaft portion 36 of each button 18 is received within a corresponding protrusion 30 of the elastic member 16 by a close-fitting relationship. Also, depression of one button 18 of the plurality of buttons 18 results in the closed end 30*b* of the corresponding protrusion 30 moving in the direction parallel to the tubular length L of the protrusion 30. Further, the elastic member 16 has a thickness between the first and second major surfaces 26 and 28, respectively, and between at least one immediately adjoining pair of the plurality of the protrusions 30, such that the first major surface 26 is maintained in continuous direct contact with the cover plate 14 and the second major surface 28 is maintained in continuous direct contact with the support surface 20 between the at least one immediately adjoining pair of the plurality of the protrusions 30.

The protrusion 30, in an unstretched state, is preferably of a uniform radial thickness $T_R$ around the remainder of the length of the shaft portion 36 of the button 18 received therein. The closed end 30*b* of the protrusion 30 preferably has an axial thickness $T_A$ greater than the uniform radial thickness $T_R$ of the tubular wall 32 around the remainder of the length of the shaft portion 36 received within the protrusion 30 to resist puncture by the distal tip 36*a* of the shaft portion 36. The axial thickness $T_A$ of the closed end 30*b* of the above described protrusion 30 is approximately 0.060 inches. The axial thickness $T_A$ of the closed end 30*b* is preferably relatively thick to provide added wear resistance because the closed end 30*b* of the protrusion 30 is the end that contact a switch element 48, as discussed more fully below. A relatively smaller radial thickness $T_R$ of the tubular wall 32 is preferable so that less water pressure acts upon the device 10. Specifically, the radial thickness $T_R$ of the tubular wall 32 is directly related to the spring force exerted by the elastic member 16 against depression of the button 18. Thus, the radial thickness $T_R$ may be adjusted based on the spring force required for the desired depth of use of the device 10.

As an example, for an elastic member 16 made of silicone and used with buttons 18 having shaft portions 36 with a maximum diameter of 0.093 inches and a range of motion of 0.080 inches, the radial thickness $T_R$ of the unstretched tubular member 32 around the maximum shaft diameter is preferably approximately 0.200 inches and the axial thickness $T_A$ of the closed end 30*b* is approximately 0.500 inches. These dimensions provide a stretch of less than 0.080 inches of the protrusion 30 from water pressure on the button 18 at a depth of more than sixty meters. The materials of construction of the various components, such as the material of the elastic member 16, will affect the dimensions of the protrusion 30.

Also, the elastic member 16 maintains continuous direct contact with the support surface 20 and the cover plate 14 regardless of whether the protrusion 30 is relaxed (i.e., unstretched) or stretched. Further, because the elastic member 16 is tightly retained between the cover plate 14 and the support surface 20, depression of the button 18 will not cause stretching of this portion of the elastic member 16. Accordingly, no gaps are created between the elastic member 16 and the cover plate 14 or the elastic member 16 and the support surface 20 by depression of the button 18. Accordingly, the close-fitting relationship of the elastic member 16, the support surface 20 and the cover plate 14 is sufficiently maintained to form a waterproof seal even when the button 18 is depressed.

The waterproof operating device 10 also includes at least one switch element, indicated generically by block 48, and more preferably a plurality of switch elements 48, not depicted, each associated with one of the plurality of protrusions 30. The switch element 48 is located within the pressure resistant housing 12 in a position so as to be actuated by the closed end 30*b* of the protrusion 30 of the elastic member 16 with the button 18 sufficiently depressed. Specifically, the switch element 48 is located within the housing 12 proximate to, but spaced apart from, the distal closed end 30*b* of the protrusion 30. With the elastic member 16 being maintained in direct contact and close-fitting relationship with the cover plate 14 and the support surface 20, the elastic member 16 provides a waterproof barrier for the plurality of openings 22 and 24 through the support surface 20 and cover plate 14, respectively, such that water cannot reach the switch element(s) 48.

As described above, depressing the button 18 causes movement of the shaft portion 36 and stretching of the protrusion 30 in the direction parallel to the tubular length L of the protrusion 30. Accordingly, the closed end 30*b* moves in the direction parallel to the tubular length L to directly contact and actuate the switch element 48 located directly opposite and proximate to the closed end 30*b*. Thus, depression of the button 18 directly actuates the switch element 48 to initiate the desired operation.

Alternatively, the switch element 48 may be indirectly actuated by the button 18. According to this embodiment, a lever (not shown) is positioned proximate to and between the closed end 30*b* and the switch element 48. When the button 18 is depressed, the protrusion 30 is stretched and the closed end 30*b* moves until it contacts the lever. Further depression of the button 18 causes the lever to move or pivot from a first position to a second or actuation position. In the second position, the lever directly contacts and then actuates the switch element 48.

Where the waterproof operating device 10 includes a plurality of openings 22, 24, protrusions 30, buttons 18 and switch elements 48 clustered together, the waterproof operating device 10 essentially constitutes or includes a waterproof keypad 100. Specifically, referring to FIGS. 1-2, according to this embodiment, the support surface 20 of the housing 12 has a plurality of openings 22 formed therethrough; the cover plate 14 includes a plurality of raised cylindrical sections 15, a plurality of wells 38 formed therein, and a plurality of openings 24 formed therethrough; and the elastic member 16 has a plurality of the protrusions 30. The support surface 20 rests within a depression formed within the housing 12 and has edge or sidewalls 21 which extend upwardly away from a surface 20*a* of the support surface 20 and receive and confine the elastic member 16 on all sides, except for the first major surface 26.

The openings 22, the openings 24 and the protrusions 30 are positioned at corresponding spaced apart locations, such that their positions all correspond with each other so as to be coaxially aligned. Accordingly, with the cover plate 14 positioned over the support surface 20, the positions of the plurality of openings 24 in the cover plate 14 correspond to (i.e. align with) the positions of the plurality of openings 22 in the support surface 20. Also, with the elastic member 16 positioned between the cover plate 14 and the support surface 20, the tubular wall 32 of each protrusion 30 passes through a corresponding opening 22 of the plurality of openings 22 in the support surface 20. Because the openings 22 in the support surface 20, the openings 24 in the cover plate 14, and the protrusions 30 of the elastic member 16 are of corresponding positions, the cover plate 14, elastic member 16 and the support surface 20 preferably have essentially the same length and width dimensions, such that they are of substantially the same area.

According to this embodiment, the plurality of switch elements 48 are located within the pressure resistant housing 12, such that one of the plurality of switch elements 48 is actuated by the closed end 30*b* of a separate one of the plurality of protrusions 30. Specifically, by sufficient depression of the corresponding button 18 of the protrusion 30, one of the plurality of switch elements 48 is actuated, directly or indirectly, by the closed end 30*b* of the corresponding protrusion 30.

The configuration of the buttons 18 in the cover plate 14 along with the design of the elastic member 16 and, more particularly, the design of the protrusions 30, allows for superior resistance of the waterproof operating device 10 against water pressure that is inevitably exerted on the button 18 when the device 10 is used in an underwater application. The effect of water pressure is diminished by the clearance provided between the head portion 34 of each button 18 and the inner wall of the well 38 receiving the button. As such, the net force applied by water to the button 18 is proportional to only the diameter of the button shaft 36, as opposed to the diameter of the head portion 34 which is generally substantially larger than the diameter of the shaft portion 36. Such water pressure will cause increasingly greater depression of the button 18 with increasing depth and, thus, could cause unintentional actuation of the switch element 48. However, the elastic member 16 of the present invention acts a spring to counteract the water pressure on the button shaft portion 36 and to prevent unintentional actuation of the switch element 48.

Specifically, the protrusion 30 of the elastic member 16 is dimensioned for the material used and the desired range of motion of the button 18 to be sufficiently resilient to resist water pressure exerted on the button 18 to a depth in water of greater than ten meters (approximately thirty-three feet) and, preferably, up to a depth in excess of thirty meters (approximately one hundred feet), for example, about forty meters (approximately one hundred and thirty feet), and even more preferably, up to a depth of at least sixty meters (approximately two hundred feet), without actuation of the proximal switch element 48. It will be appreciated that the protrusions 30 of the elastic member 16 can be designed for any level of resistance to water pressure for any desired depth by controlling the stretch of the protrusion 30. It will be appreciated that for any elastomer selected, the amount of stretch of a protrusion 30 for a given pressure level (depth) is controlled by the selected combination of material wall thickness and length (unstretched) of the protrusion 30.

According to the waterproof keypad embodiment, each protrusion 30 of the elastic member 16 has the above described configuration and dimensions. Thus, each protrusion 30 is sufficiently resilient to resist water pressure exerted on the corresponding button 18 to a depth in water of greater than ten meters (approximately thirty-three feet), at least up to thirty meters (approximately one hundred feet) and preferably up to at least sixty meters (approximately 200 feet), without actuation of one of the plurality of switch elements 48.

It will be appreciated by those skilled in the art that changes could be made to the embodiments described above without departing from the broad inventive concept thereof. It is understood, therefore, that this invention is not limited to the particular embodiments disclosed, but is intended to cover modifications within the spirit and scope of the present invention as described by the appended claims.

I claim:

1. A waterproof operating device comprising:

a pressure resistant housing including a support surface having at least one opening formed therethrough;

a cover plate positioned over the support surface and having at least one opening formed therethrough located over the at least one opening formed through the support surface;

an elastic member located between the support surface and the cover plate, the elastic member having a first major surface in direct contact with the cover plate, a second major surface opposite the first major surface in direct contact with the support surface and at least one protrusion extending from the second major surface and through the at least one opening through the support surface, the protrusion comprises an open end at the first major surface aligned with the at least one opening through the cover plate, an opposing closed end and a tubular wall extending between the second major surface and the opposing closed end and passing through the at least one opening in the support surface;

at least one button having a head portion and a shaft portion, wherein a majority of an entire length of the shaft portion is received within the protrusion of the elastic member in a close-fitting relationship, a distal tip of the shaft portion engaging the closed end of the protrusion, wherein the protrusion of the elastic member is stretched in a direction parallel to a tubular length of the protrusion with the button being depressed; and at least one switch element located proximate to the closed end of the protrusion of the elastic member, wherein the closed end of the protrusion actuates the switch element with the button sufficiently depressed;

wherein the elastic member has a thickness from the protrusion radially outward all around the protrusion, such that the first major surface is maintained in continuous direct contact with the cover plate and the second major surface is maintained in continuous direct contact with the support surface from the at least one opening through the support surface receiving the protrusion and the button and the at least one opening through the cover plate outward to at least beyond an area covered by the head portion of the button.

2. The waterproof operating device according to claim 1, wherein the protrusion of the elastic member resists water pressure exerted on the button to a depth in water of greater than ten meters (thirty three feet) without actuation of the switch element.

3. The waterproof operating device according to claim 2, wherein the protrusion of the elastic member resists water pressure exerted on the button to a depth in water of up to at least sixty meters (two hundred feet) without actuation of the switch element.

4. The waterproof operating device according to claim 1, wherein the head portion of the button is received within a well formed in the cover plate, such that a radial clearance is provided between a radial periphery of the head portion and an inner wall of the well, the head portion comprising a first major surface facing away from the well for contact by a user and a second major surface opposite the first major surface and facing the cover plate, and depression of the button being limited by contact with the switch element or a bottom of the well.

5. The waterproof operating device according to claim 1, wherein the elastic member includes a ridge protruding from the second major surface around at least a portion of a circumference of the protrusion and the support surface includes a recessed area configured to receive the ridge.

6. The waterproof operating device according to claim 5, wherein the ridge completely and unbrokenly surrounds the circumference of the protrusion.

7. The waterproof operating device according to claim 1, wherein the support surface is inelastic.

8. The waterproof operating device according to claim 1, wherein the elastic member is an elastomeric membrane comprising one or more materials selected from the group consisting of silicone, urethane, and EPDM rubber.

9. The waterproof operating device according to claim 1, wherein the tubular wall of the protrusion unstretched is of a uniform radial thickness around the length of the shaft portion of the button received within the protrusion.

10. The waterproof operating device according to claim 9, wherein the tubular wall has a length and thickness selected to generate a spring force sufficient to prevent extension of the tubular wall sufficiently to actuate the switch element by water pressure alone at depths more than sixty meters (two hundred feet).

11. The waterproof operating device according to claim 9, wherein the closed end of the protrusion has an axial thickness greater than the uniform radial thickness of the tubular wall around the length of the shaft portion received within the protrusion.

12. The waterproof operating device according to claim 1, wherein the elastic member maintains continuous direct contact with the support surface and the cover plate regardless of whether the protrusion is unstretched or stretched.

13. The waterproof operating device according to claim 1, wherein the distal tip of the shaft portion comprises an elongated body and a flange, the elongated body having a diameter less than a diameter of a remainder of the shaft portion and the button being secured within the protrusion of the elastic member by the flange.

14. The waterproof operating device according to claim 1, wherein the elastic member provides a waterproof barrier for a plurality of button openings through the cover plate and the support surface.

15. The waterproof operating device according to claim 14, wherein the elastic member includes a plurality of protrusions extending from the second major surface, each protrusion underlying one of the plurality of button openings through the cover plate and extending through a separate button opening of the plurality of button openings through the support surface, wherein the elastic member has between at least one adjoining pair of the plurality of protrusions, a uniform thickness between the first and second major surfaces, such that the first major surface is maintained in continuous direct contact with the cover plate and the second major surface is maintained in continuous direct contact with the support surface between the at least one adjoining pair of the plurality of protrusions.

16. The waterproof operating device according to claim 15, wherein the elastic member includes a ridge protruding from the second major surface and the support surface includes a recessed area configured to receive the ridge, the ridge completely and unbrokenly surrounding the plurality of protrusions.

17. The waterproof operating device according to claim 1, wherein the support surface, cover plate and elastic member are removably secured to each other by a plurality of retaining members.

18. The waterproof operating device according to claim 17, wherein the support surface includes a plurality of threaded recesses and the retaining members are threaded fasteners.

19. A waterproof keypad comprising:

a pressure resistant housing including a support surface having a plurality of openings formed therethrough;

a cover plate positioned over the support surface and having a plurality of openings formed therethrough, the openings formed through the cover plate being located over the openings formed through the support surface;

an elastic member located between the support surface and the cover plate, the elastic member having a first major surface in direct contact with the cover plate, a second major surface opposite the first major surface in direct contact with the support surface and a plurality of protrusions extending from the second major surface and through the plurality of openings in the support surface, each protrusion comprising an open end at the first major surface aligned with a corresponding opening through the cover plate, an opposing closed end and a tubular wall extending between the second major surface and the opposing closed end and passing through a corresponding opening through the support surface, wherein the elastic member has a thickness between the first and second major surfaces that is essentially constant between at least one adjoining pair of the plurality of the protrusions; and a plurality of buttons, each button having a head portion and a shaft portion, wherein at least a portion of a length of each shaft portion is received within a corresponding protrusion of the elastic member by a close-fitting relationship, a distal tip of the shaft portion engaging the closed end of the protrusion, wherein each protrusion of the elastic member is stretched in a direction parallel to a tubular length of the protrusion with the corresponding button being depressed.

20. The waterproof keypad according to claim 19, wherein the elastic member has a thickness between the first and second major surfaces and between at least one immediately adjoining pair of the plurality of the protrusions, such that the first major surface is maintained in continuous direct contact with the cover plate and the second major surface is maintained in continuous direct contact with the support surface between the at least one immediately adjoining pair of the plurality of the protrusions and from each opening through the support surface and each opening through the cover plate outward to at least beyond an area covered by the head portion of each button.

21. The waterproof keypad according to claim 20, wherein the cover plate, elastic member and support surface are of substantially the same area.

22. The waterproof keypad according to claim 20, further comprising a plurality of switch elements located within the pressure resistant housing so as to be actuated by the closed end of a separate one of the plurality of protrusions of the elastic member with the corresponding button of the protrusion sufficiently depressed.

23. The waterproof keypad according to claim 22, wherein each protrusion of the elastic member resists water pressure exerted on corresponding button to a depth in water of greater than ten meters (thirty three feet) without actuation of a switch element of the plurality of switch elements.

24. The waterproof keypad according to claim 23, wherein each protrusion of the elastic member resists water pressure exerted on the corresponding button to a depth in water of greater than sixty meters (two hundred feet) without actuation of a switch element of the plurality of switch elements.

* * * * *